United States Patent [19]

Betts et al.

[11] 4,151,366

[45] Apr. 24, 1979

[54] FLAME RESISTANT, INSULATED MULTI-CONDUCTOR ELECTRIC CABLE

[75] Inventors: Joseph E. Betts, Westport; Alfred C. Bruhin, Huntington, both of Conn.; Robert P. Hoeppner, Glen Ellyn, Ill.

[73] Assignee: General Electric Company, New York, N.Y.

[21] Appl. No.: 811,588

[22] Filed: Jun. 30, 1977

[51] Int. Cl.[2] ..... H01B 3/28

[52] U.S. Cl. ..... 174/116; 174/110 B; 174/110 PM; 174/110 SY; 174/121 A

[58] Field of Search ..... 174/121 A, 110 PM, 110 SY, 174/110 B, 116; 428/921

[56] References Cited

U.S. PATENT DOCUMENTS

| | | | |
|---|---|---|---|
| 3,571,490 | 3/1971 | Bunish | 174/121 A |
| 3,745,233 | 7/1973 | Lania et al. | 175/121 A |
| 3,772,455 | 11/1973 | Nicodemus et al. | 174/121 A |
| 3,823,255 | 7/1974 | La Gase et al. | 174/121 A |
| 3,843,831 | 10/1974 | Hutchison et al. | 174/121 A |
| 3,922,459 | 11/1975 | Franz et al. | 428/921 |
| 4,005,241 | 1/1977 | O'Neill | 428/921 |
| 4,022,945 | 5/1977 | Mackenzie, Jr. et al. | 174/110 PM |

*Primary Examiner*—Richard R. Kucia
*Assistant Examiner*—J. Bouchard
*Attorney, Agent, or Firm*—R. G. Simkins; P. L. Schlamp

[57] ABSTRACT

An insulated, multi-conductor electrical cable having a low halogen content and a high degree of resistance to flame and combustion.

16 Claims, 1 Drawing Figure

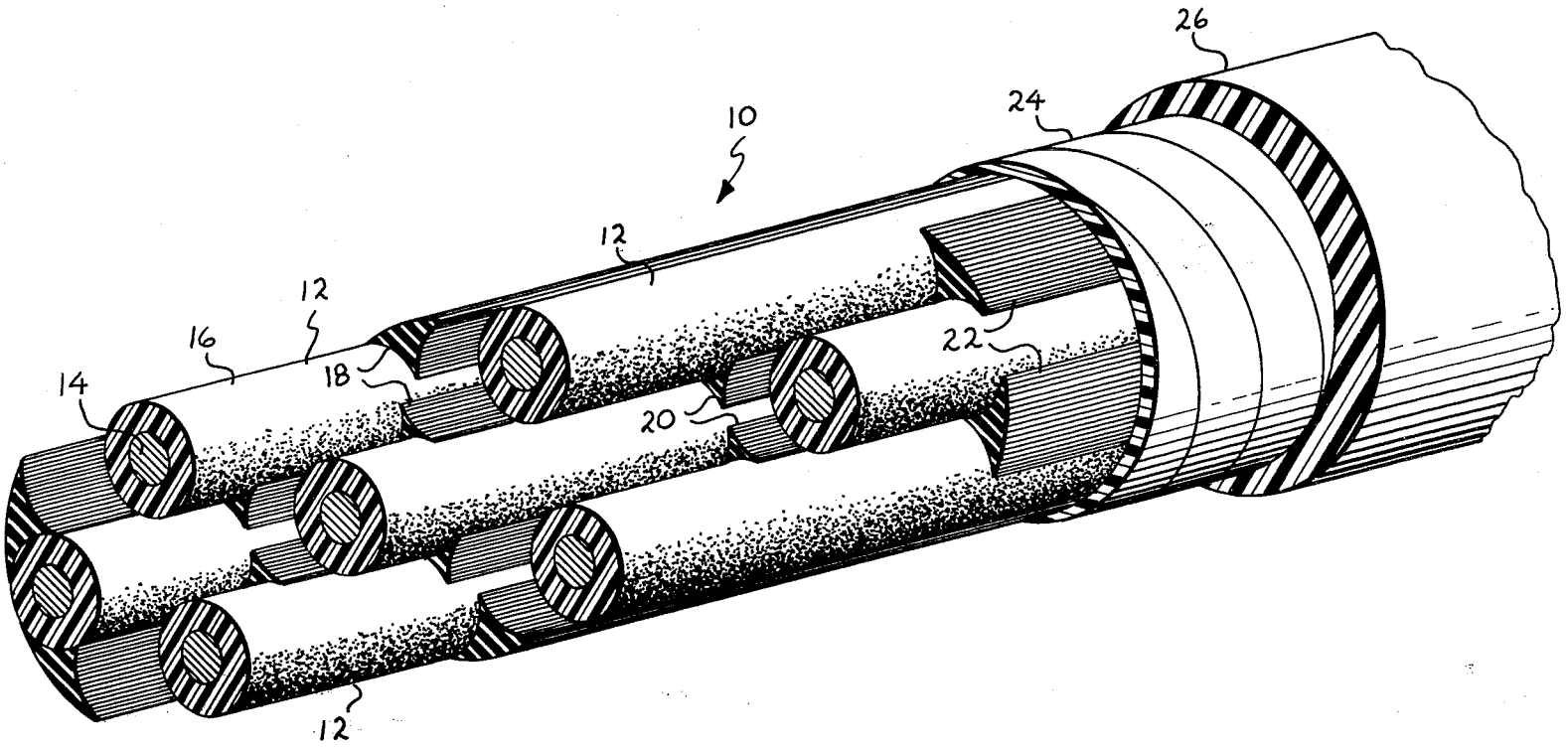
26
24
22
10
20
12
18
12
16
14
12

FLAME RESISTANT, INSULATED MULTI-CONDUCTOR ELECTRIC CABLE

BACKGROUND OF THE INVENTION

Common flame retarding agents for imparting resistance to flame or combustion in flammable compositions such as organic polymers, or flame barrier materials for protecting flammable compositions from heat and flame or in general obstructing the spread of fire, typically comprise caustic or corrosive, noxious or otherwise potentially deleterious materials, such as halogens or asbestos.

Morover, the possible problems entailed with the use of such materials in all phases of their application or service, including their handling and storage, their presence within products, and their chemical and/or physical behavior in performing their designed function of inhibiting combustion, has become a subject of intensive and extensive concern in recent years, notwithstanding their significant contribution in saving lives and property from distruction or damage by fire.

Both the attainment of effective resistance to fire, and the potential problems of conventional flame retarding agents and barrier materials such as halogens and asbestos, have become especially critical factors with respect to insulated electrical wire and cable products because of the possibility of fires in electrical current carrying means, their frequent use in occupied buildings and in close proximity to personnel as well as highly flammable materials and/or costly apparatus such as electric motors, control means and machine tools.

SUMMARY OF THE INVENTION

This invention comprises an improved, insulated multi-conductor electrical cable product having a high level of resistance to flame and combustion and also a low halogen content with no asbestos or like inorganic fiber. The high degree of resistance to flame or combustion of the improved cable product of this invention, notwithstanding a significant reduction in halogen content and the absence of asbestos, is substantially attributable to the novel combination and arrangement of its components and their respective compositions, all in concert.

The flame resistant, insulated multi-conductor cable products of this invention are especially useful for service as power and/or regulating control cables for system controls, motor and machine control units, and related variable purpose or condition apparatus because it can contain substantially any number of individually insulated electrical conductors for a plurality of circuits, and also provide a high degree of resistance to combustion in a fire prone environment with a minimum content of hazardous ingredients.

OBJECTS OF THE INVENTION

It is a primary object of this invention to provide improved, insulated multi-conductor cable products.

It is also an object of this invention to provide insulated, multi-conductor cable products having improved resistance to flame or combustion and the propagation thereof.

It is a further object of this invention to provide flame resistant, insulated multi-conductor cable products which contain a low quantity of halogen and are devoid of asbestos and other deleterious agents.

It is a still further object of this invention to provide improved flame resistant, insulated multi-conductor cable products having therein substantially reduced amounts of noxious or corrosive flame-resisting agents such as halogens, and which have substantially improved electrical and physical properties and are uniquely suitable for service as control cable.

BRIEF DESCRIPTION OF THE DRAWING

The drawing comprises a perspective view of an insulated, multi-conductor cable product comprising the construction and components of this invention.

DESCRIPTION OF A PREFERRED EMBODIMENT

The improved flame resistant, insulated multi-conductor electrical cables according to this invention, comprises a combination of assembled components of particular compositions or ingredients which act in concert to provide a composite cable product having acceptable electrical and physical properties and substantially improved resistance to fire or flame and propagation thereof.

Referring to the drawing, the composite cable 10 of this invention includes a multiplicity of individually insulated conductors 12, each comprising an electrical conductor 14, of either stranded or solid wire, enclosed within a covering body or coating of dielectric insulation 16. The insulation 16 comprises a cross-link cured, ethylene-containing polymer such as polyethylene. The ethylene-containing polymer compound for the insulation includes minimal amounts, such as about 30 to about 50 parts by weight per 100 parts by weight of polymer, of a conventional bromine-containing flame-retarding agent such as decabromobiphenyl oxide, providing therein about 15 to about 25 percent by weight of halogen content, and antimony oxide, in addition to the usual additives to effect the cure, such as an organic peroxide cross-linking agent, and the usual additives to preserve the chemical and physical properties of the polymer compound, such as conventional antioxidants and stabilizers for the polymer composition.

Additional suitable brominated flame retarding agents comprise hexabromobiphenyl, octobromobiphenyl and pentabromotoluene.

Ethylene-containing polymers suitable for the instulating compound for this invention comprise polyethylene, copolymers of high ethylene content with other polymerizable materials, and high ethylene content blends of such polymers including copolymer. For example copolymers of major amounts of ethylene with minor amounts of propylene, vinyl acetate, alkyl-acrylate or butene.

The ethylene-containing polymers are cross-link cured or thermoset by means of a heat-activated organic peroxide curing agent such as disclosed in U.S. Pat. Nos. 2,888,424; 3,079,370; 3,086,966; and 3,214,422, or by irradiation.

A plurality of such individually insulated conductors 12 in a given total quanity, are stranded or grouped together side-by-side in an appropriate, generally parallel arrangement such as illustrated in the drawing, and thus combined with an apt number of filler or spacer units 18. The filler or spacers 18 comprise elongated strips conformed to a suitable cross-sectional shape or shapes to complement the particular configuration of the arrangement of the grouped together, generally cylindrically shaped insulated conductors 12, so as to occupy and substantially fill the interstitial void spaces formed intermediate the generally parallel arranged insulated conductors 12. For instance, with a stranded group of side-by-side generally cylindrical insulated conductors 12 such as illustrated in the drawing, the internal filler strips 20 would be pressed to a generally triangular configuration with concave sides to complement the internal interstices, and external or surface filler strips 22 which occupy the interstices adjoining the outer surface intermediate the parallel insulated conductors 12 would be pressed to a generally triangular configuration with an outer convex side or base and two concave sides to complement the surface interstices.

The filler strips 18 perform a many functional role in this invention, including the prevention of distortion or deformation of both the individual insulated conductors 12, and the composite body of their grouped arrangement, provide a substantially smooth or regular and continuous outer surface contour around the composite body, and preclude the presence of any significant voids or open spaces within the composite body of the grouped arrangement of insulated conductors 12.

Although it is highly preferred in the practice of this invention that substantially all interstitial voids between the insulated conductors 12 be occupied with filler strips 18 to preclude the presence of any significant void areas, and to minimize any distortion and maximize the surface regularity, it is also within the scope of this invention to apply the filler strips 18 only to the interstices which are most strategic or critical with respect to the primary objective of this invention, effective resistance to flame and its propagation.

In accordance with this invention, the filler strips 18, or at least a substantial portion thereof, are composed of styrene-butadiene copolymer rubber containing substantial quantities of hydrated aluminum oxide filler, namely aluminum oxide trihydrate ($Al_2O_3$ $3H_2O$). The amount of alumina hydrate filler should be substantially greater than the amount of styrene-butadiene copolymer, for example at least about 150 parts by weight of alumina hydrate filler, and preferably about 200 to 250 parts thereof, per 100 parts by weight of the styrene-butadiene copolymer.

The styrene-butadiene copolymer, of course, preferably includes the usual additives to enhance its compounding and shaping or molding, and to preserve its designed chemical and physical properties, such as conventional antioxidants and preservatives suitable for styrene-butadiene copolymer.

An exemplative formulation for the filler strips of this invention which contribute significantly to the flame resistance of the composite multi-conductor cable product, is as follows in relative parts by weight.

| | Parts by Weight |
|---|---|
| Styrene-Butadiene Copolymer | 100 |
| Hydrated Alumina | 225 |
| Aromatic Petroleum Resin Processing Acid (Hercules-Picco Resin 6100-1½) | 15 |
| Zinc Oxide | 5 |
| Paraffin Wax | 6 |
| Crystalline Hydrocarbon Wax | 3 |
| Stearic Acid | 1 |
| Methyl Tuads | 3 |

The side-by-side arranged group of insulated conductors 12 with the interlaid filler strips 18, for the purposes of this invention, can be retained aligned in a straight parallel pattern as illustrated in the drawing, or the conductors 12 and interlaid strips 18 can be axially twisted into a conventional spiral or helical cable construction.

A stranded side-by-side grouping of an appropriate number and arrangement of the insulated conductors 12, combined with the hydrated alumina filled, styrene-butadiene rubber filler strips 18 interlaid among the insulated conductors 12 in a pattern to occupy the interstititial voids, is bundled together into a single multi-conductor unit with a wrapping of tape 24. The tape preferably consists of a plastic film such as Mylar polyester (ethylene-glycol terphthalate) of about one to three or four mils thick, and can be wrapped helically, as illustrated, or longitudinally around the grouped arrangement of insulated conductors 12 combined with the filler strips 18.

The bundle of tape 24 wrapped insulated conductor 12 and filler strips 18, is enclosed within a durable protective jacket or sheath 26, such as a neoprene (chloroprene) or Hypalon (chlorosulfonated polyethylene) outer jacket.

As indicated hereinbefore, the unique combination and arrangement of the components and their compositions of this invention provides a multi-conductor insulated cable having improved resistance to flame and its propagation while containing low, reduced amounts of halogen and no asbestos or similar deleterious ingredients.

The improvement and advantages of the novel multi-conductor insulated electrical cable of this invention, in relation to a similarly constructed and comparable multi-conductor cable product as a standard, is demonstrated by the following examples of this invention and the data derived therefrom.

In the following examples for the multi-conductor cable 10 of this invention, the dielectric insulation 16 for the conductors 14, comprised cross-link cured polyethylene containing 40 parts by weight of decabromobiphenyl oxide and 14 parts by weight of antimony trioxide. The halogen content therefore was 19% by weight.

The filler strips 18 which occupied all interstitial voids as is illustrated in the drawing, were composed of 100 parts by weight of styrene-butadiene copolymer containing 225 parts by weight of aluminum oxide trihydrate filler and of the formulation given above.

The wrapping was a Mylar film tape about one mil thick, and the enclosing protective jacket was neoprene about 60 mils thick.

The standard comprised a similarly constructed multi-conductor cable which was the same as the cable of the examples of this invention in all aspects except as following. In the standard multi-conductor cable, the dielectric insulation, comparable to insulation 16, was a high halogen content material comprising a blend of equal parts of polyvinyl chloride and chlorinated polyethylene combined with about 20 parts by weight of antimony oxide per 100 parts by weight of the polymer blend. The total halogen content for the insulation of the standard cable was 27.8% by weight, compared with 19% halogen content for the insulation of the cable of the invention.

The cable of the standard comprised the same number — seven — and arrangement of insulated conductors with all interstitial voids occupied, as is illustrated in the drawing and the same as in the cable of the examples of this invention, with filler strips composed of neoprene (chloroprene), having a halogen content of 14.6% by weight, for the purpose of contributing to the flame resistance of the cable.

The wrapping tape used in the cable of the standard consisted of a heat barrier laminate of a felt sheet of asbestos, about nine mils thick, on a mylar film about one mil thick.

The enclosing protective jacket of the cable standard was identical to its counterpart for the examples of this invention, a covering of neoprene about 60 mils thick.

Several samples of examples of the cable of this invention and of the standard of a comparable cable having a high halogen content for flame resistance and an asbestos heat barrier were tested under identical conditions for a comparison of their respective properties. The evaluations include testing of the individually insulated conductors 12 of the low halogen content insulating composition used in the cable of this invention, and of the high halogen content insulation composition for flame resistance of the standard cable described.

The comparative tests and resultant data for each phase of evaluating the individual insulated conductor component and complete composite multi-conductor cable for each of several examples of this invention and also several examples of the standard are given in the following table.

TABLE

| Property | EXAMPLES OF INVENTION INSULATION I | II | III | IV | V | VI | STANDARD A | B | C |
|---|---|---|---|---|---|---|---|---|---|
| Original | | | | | | | | | |
| Tensile, psi | 2522 | 2436 | 2405 | 2509 | 2635 | 2572 | 2291 | 3120 | 2887 |
| Elongation, % | 387 | 387 | 380 | 383 | 383 | 383 | 244 | 278 | 270 |
| Hot Modulus, psi | 124.6 | 104.6 | 82.7 | 107.8 | 107.8 | 104.6 | 206 | 186 | 182 |
| 7 Days, 121° C. Oven — | | | | | | | | | |
| % Ret. Tensile | 94 | 102 | 89 | 100 | 94 | 99 | 108 | 109 | 108 |
| % Ret. Elongation | 95 | 100 | 103 | 100 | 98 | 102 | 70 | 74 | 72 |
| 121° C. Heat Distortion, % | 9.84 | 10.1 | 8.09 | 8.52 | 10.55 | 10.78 | | | |
| UL FR-1 Vertical Flame | | | | | | | | | |
| Original | Pass | Pass | Pass | Pass | Pass | Pass | Pass | Pass | Pass |
| Aged 17 Days, 121° C | Pass | Pass | Pass | Pass | Pass | Pass | Pass | Pass | Pass |
| EM-60, 75° C. | | | | | | | | | |
| SIC After 24 Hours | — | — | 2.37 | — | — | — | 4.98 | 4.48 | 4.24 |
| % Change in SIC | | | | | | | | | |
| 1–14 Days | — | — | 0.84 | — | — | — | −3.41 | −5.58 | −4.72 |
| 7–14 Days | — | — | 0.42 | — | — | — | 0.42 | 0.48 | 0.50 |
| Stability Factor | — | — | 0.03 | — | — | — | 0.17 | 0.09 | 0.12 |
| Alt. Stab. Factor | — | — | 0.01 | — | — | — | 0.01 | 0.02 | 0.18 |
| Gravemetric Moisture Absorption, mg/in$^2$ | | | | | | | | | |
| Oxygen Index | 28.89 | 28.64 | 28.58 | 28.82 | 28.52 | 28.58 | (— — | — 30— | — — —) |
| % Halogen | (— — — — — — — | —19— | — — — — — —) | | | | (— | 27.8 | ) |
| Specific Gravity | ( | 1.27 | ) | | | | ( | 1.60 | ) |

| Property | COMPARISON OF INTERSTICE FILLERS FILLER OF INVENTION | FILLER OF STANDARD |
|---|---|---|
| Oxygen Index | .338 | .43 |
| % Halogen | 0 | 14.6 |
| Specific Gravity | 1.55 | 1.57 |
| COMPARISON OF COMPLETED CABLE | | |
| Gms of Halogen/Ft. of seven conductor cable #12 Awg. 600 V. Cable | 8.656 | 13.769 |
| Propagation after IEEE 383-1974 70,000 BTU/Hrs. Flame Test seven conductor #12 Awg 600 V. Cable | 25" | 36" |
| Cable contains asbestos | No | Yes |

As is evident from the data given in the Table, the similarly designed and electrically performing equivalent, multi-conductor cable product of this invention, containing significantly smaller amounts of halogen, about 40% less, and no asbestos, provides substantially greater resistance to flame and its propagation (25 inches), than that (36 inches) afforded by the high halogen and asbestos barrier containing comparable cable standard.

Specifically, the improved flame resistance of the lower halogen and asbestos free multi-cable product of this invention exhibited a reduction in flame propagation about 30% less than the resistance provided by the high halogen and asbestos containing multi-conductor cable standard.

Although the invention has been described with reference to certain specific embodiments thereof, numerous modifications are possible and it is desired to cover all modifications falling within the spirit and scope of this invention.

What we claim as new and desire to secure by Letters Patent of the United States is:

1. A Flame-resisting, insulated multi-conductor electrical cable, consisting essentially of:

(a) a plurality of electrical conductors individually insulated with a cross-link cured ethylene-containing polymer compound including a halogen-containing flame retarding agent, said plurality of insulated electrical conductors being stranded together in a side-by-side group arrangement having interstices therebetween;

(b) a plurality of elongated filler strips composed of styrene-butadiene copolymer containing hydrated alumina filler therein occupying interstices formed intermediate the stranded insulated conductors; and (c) an enclosure surrounding the group of stranded insulated conductors with elongated filler strips occupying the interstices.

2. The flame-resisting cable of claim 1, wherein the conductor insulation of an ethylene-containing polymer compound has a halogen content of about 15% to about 25% by weight of halogen.

3. The flame-resisting cable of claim 1, wherein the conductor insulation of an ethylene-containing polymer compound contains about 30 to about 50 parts by weight of decabromobiphenyl ether per 100 parts by weight of the polymer.

4. The flame-resisting cable of claim 1, wherein the filler strips of styrene-butadiene copolymer contain at least about 150 parts by weight of hydrated alumina filler per 100 parts by weight of the copolymer.

5. The flame-resisting cable of claim 1, wherein a tape of Mylar polyester is wrapped around the group of stranded insulated conductors with filler strips.

6. A flame-resisting, insulated multi-conductor electrical cable, consisting essentially of:

(a) a plurality of electrical conductors individually insulated with a cross-link cured ethylene containing polymer compound containing about 30 to about 50 parts by weight of decabromobiphenyl ether per 100 parts by weight of polymer, said plurality of insulated electrical conductors being stranded together in a side-by-side group arrangement having interstices therebetween;

(b) a plurality of elongated filler strips composed of styrene-butadiene copolymer containing at least about 150 parts by weight of hydrated alumina filler per 100 parts by weight of the copolymer occupying interstices formed intermediate the stranded insulated conductors;

(c) a polymer tape wrapped around the group of stranded insulated conductors with elongated filler strips occupying interstices therebetween, forming a composite bundle thereof; and, (d) a durable protective jacket enclosing the tape wrapped bundle of insulated conductors and filler strips.

7. The flame-resisting cable of claim 6, wherein the ethylene-containing polymer is polyethylene.

8. The flame-resisting cable of claim 6, wherein the filler strips of styrene-butadiene copolymer contain about 200 to about 250 parts by weight of hydrated alumina filler per 100 parts by weight of the copolymer.

9. The flame-resisting cable of claim 6, wherein the tape wrapped around the group of stranded insulated conductors with filler strips is mylar polyester film.

10. The flame-resisting cable of claim 6, wherein the durable protective jacket consists of at least one durable polymer selected from the group consisting of chloroprene and chlorosulfonated polyethylene.

11. A flame-resisting, insulated multi-conductor electrical cable, consisting essentially of:

(a) a plurality of electrical conductors individually insulated with a cross-link cured polyethylene compound including a halogen-containing flame retarding agent, said plurality of insulated electrical conductors being stranded together in a side-by-side group arrangement having interstices therebetween;

(b) a plurality of elongated filler strips composed of styrene-butadiene copolymer containing about 150 to about 250 parts by weight of hydrated alumina filler per 100 parts by weight of the copolymer occupying interstices formed intermediate the stranded insulated conductors;

(c) a Mylar polyester tape wrapped around the group of stranded insulated conductors with elongated filler strips occupying interstices therebetween forming a composite bundle thereof; and, (d) a durable protective jacket consisting of at least one durable polymer selected from the group consisting of chloroprene and chlorosulfonated polyethylene enclosing the tape wrapped bundle of insulated conductors and filler strips.

12. The flame-resisting cable of claim 11, wherein the halogen-containing flame retarding agent is decabromobiphenyl ether.

13. The flame-resisting cable of claim 11, wherein the polyethylene compound contains about 30 to about 50 parts by weight of decabromobiphenyl ether per 100 parts by weight of the polyethylene.

14. The flame-resisting cable of claim 11, wherein the conductor insulation of a polyethylene compound has a bromine content of about 15 percent to about 25 percent by weight.

15. The flame-resisting cable of claim 11, wherein the filler strips of styrene-butadiene copolymer contain about 200 to about 250 parts by weight of hydrated alumina filler per 100 parts by weight of the copolymer.

16. A flame-resisting, insulated multi-conductor electrical cable, consisting essentially of:

(a) a plurality of electrical conductors individually insulated with a cross-link cured polyethylene compound containing about 30 to about 50 parts by weight of decabromobiphenyl ether per 100 parts by weight of polyethylene, said plurality of insulated electrical conductors being stranded together in a side-by-side group arrangement having interstices therebetween;

(b) a plurality of elongated filler strips composed of styrene-butadiene copolymer containing about 200 to about 250 parts by weight of hydrated alumina filler per 100 parts by weight of the copolymer occupying the interstices formed intermediate the stranded insulated conductors;

(c) Mylar polyester tape wrapped aroung the group of stranded insulated conductors with elongated filler strips occupying the interstices therebetween, forming a composite bundle thereof; and, (d) a durable protective jacket of chloroprene enclosing the tape wrapped bundle of insulated conductors and filler strips.

* * * * *